US007771318B2

(12) United States Patent
Narayanaswami

(10) Patent No.: US 7,771,318 B2
(45) Date of Patent: Aug. 10, 2010

(54) DEVICE FOR MONITORING A USER'S POSTURE

(75) Inventor: Chandrasekhar Narayanaswami, Wilton, CT (US)

(73) Assignee: International Business Machines Corporation, Armonk, NY (US)

( * ) Notice: Subject to any disclaimer, the term of this patent is extended or adjusted under 35 U.S.C. 154(b) by 869 days.

(21) Appl. No.: 11/315,690

(22) Filed: Dec. 22, 2005

(65) Prior Publication Data

US 2007/0149360 A1 Jun. 28, 2007

(51) Int. Cl.
*A63B 71/00* (2006.01)

(52) U.S. Cl. ..... 482/8; 482/1; 482/9; 482/148; 600/300

(58) Field of Classification Search ..... 482/1–9, 482/900–902, 142, 148; 600/438, 595, 300; 601/33; 701/220; 73/866.4; 715/700, 706; 700/56, 62; 340/573.7
See application file for complete search history.

(56) References Cited

U.S. PATENT DOCUMENTS 6,396,509 B1 * 5/2002 Cheng ..... 715/706
6,624,853 B1 * 9/2003 Latypov ..... 348/722
6,673,027 B2 * 1/2004 Fischer ..... 600/595
6,984,208 B2 * 1/2006 Zheng ..... 600/438
2002/0166437 A1 11/2002 Nishitani et al.
2004/0011150 A1 * 1/2004 Reynolds et al. ..... 73/866.4
2004/0024312 A1 2/2004 Zheng
2006/0017654 A1 * 1/2006 Romo ..... 345/7
2006/0293617 A1 * 12/2006 Einav et al. ..... 601/33
2007/0073482 A1 * 3/2007 Churchill et al. ..... 701/220

FOREIGN PATENT DOCUMENTS

GB 2 262 810 A 6/1993
WO WO 9841815 A1 9/1998

OTHER PUBLICATIONS

Matty Bickerton, "Effects of Fibre Interactions on Conductivity, Within a Knitted Fabric Strength Sensor," Proceedings of IEE Eurowearables, 2003, pp. 67-72.

* cited by examiner

*Primary Examiner*—Glenn Richman
(74) *Attorney, Agent, or Firm*—Michael J. Buchenhorner; Vazken Alexanian

(57) ABSTRACT

A device, wearable by a user, includes: a plurality of sensor elements each for providing an indication of position of at least a part of the user's body; a receiver for receiving each indication of position provided by each of the plurality of sensor elements to provide a composite position signal. The individual sensor readings may all be transmitted to the external entity for further analysis. The sensors may be placed in different locations or positions for measuring the curvature of at least a part of the user's body.

15 Claims, 5 Drawing Sheets

DEVICE FOR MONITORING A USER'S POSTURE

FIELD OF THE INVENTION

The invention disclosed broadly relates to the field of information processing systems, and more particularly relates to the field of information processing systems used for monitoring a user's posture.

BACKGROUND OF THE INVENTION

It is well known that improper posture leads to muscular fatigue or more serious defects including carpal tunnel syndrome or repetitive stress injuries (RSI). The conditions can result from improper positioning of the arms, fingers, hands, back, or other parts of the body. However, determining the proper positions is not easy and the proper position may vary with time.

Prior attempted solutions to these problems have include posture training devices such as that discussed in U.S. Pat. No. 5,868,691 and garments with a pocket structure that is supposed to improve posture by forcing the shoulders back when the user inserts his or her hands in the pocket (see U.S. Pat. No. 5,555,566). Another prior attempted solution was a device that provided a thoracic extension (see U.S. Pat. No. 5,099,831). However, none of these prior attempted solutions provides the user or another person with feedback on the user's posture that enables the correction of posture problems and none of the prior art continuously tracks or measures the posture of the person using electronic elements.

Therefore there is a need for a device that monitors and tracks a user's posture and that provides feedback to correct any deficiencies in the user's posture.

SUMMARY OF THE INVENTION

Briefly, according to an embodiment of the invention a device, wearable by a user, includes: a plurality of sensor elements each for providing an indication of position of at least a part of the user's body; a receiver for receiving each indication of position provided by each of the plurality of sensor elements to provide a composite position signal. The individual sensor readings may all be transmitted to the external entity for further analysis. The sensors may be placed in different locations or positions for measuring the curvature of at least a part of the user's body.

DETAILED DESCRIPTION

Figure 1:
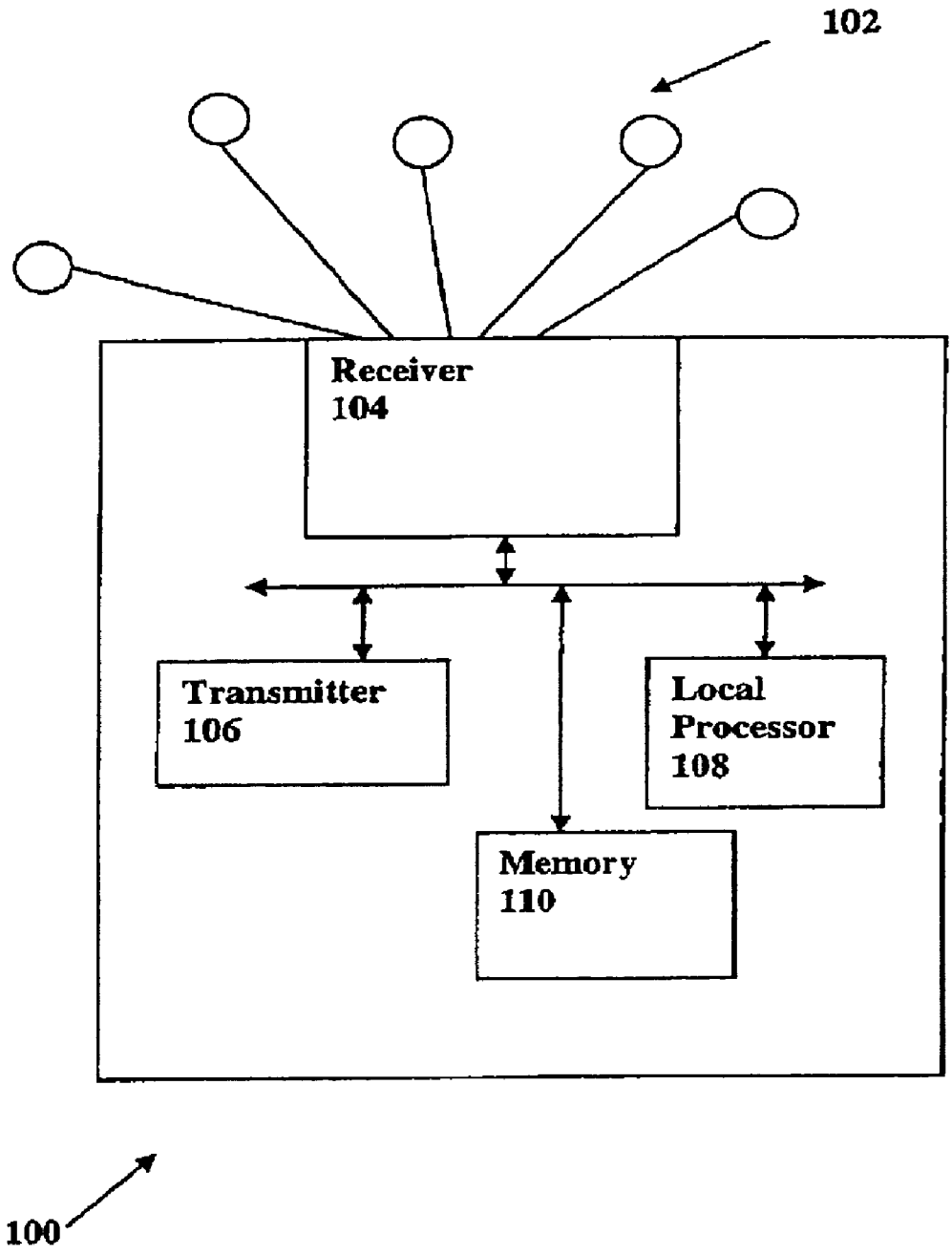
FIG. 1 shows a device for monitoring posture of a user.

Referring to FIG. 1, there is shown a highly simplified block diagram of a device 100, wearable by a user, to detect the posture of the user. The device 100 comprises a plurality of sensors 102 for attachment to different parts of the user's body, such as along the user's spine. Each sensor 102 is connected via a wire to a port in a receiver 104 so that the receiver 104 receives a signal from each sensor 102 indicating the orientation of the sensor 102. The person placing the sensors on the user enters the location of each sensor into a memory 110. However, this may be very cumbersome. The sensors may be attached to a composite unit so that once the position of one sensor is entered the rest is automatic since the relative positioning of other sensors in this composite structure is known. The person placing the sensors on the user enters the location of each sensor into a memory 110. A local processor 108 receives each of the signals provided by the receiver and computes an indication of the user's posture (e.g., current curvature of the spine) using the feedback provided by the sensors and their locations on the user's body. The memory 110 can also store an ideal posture for the user to be compared with the current posture computed by the processor 108. The processor also provides composite position signals using the data provided by each of the sensors 102. These composite position signals are to be provided to the user or the user's physician or other care provider. These signals may not only provide an indication of the posture in a manner intelligible to humans but may also provide machine readable signals for further processing by this or an external device.

The device further comprises a transmitter 106 for transmitting the composite position signals and possibly other data to a processor external and also possibly remote from the device 100. An example of an external device is a computer at a physician's office. In one embodiment, the transmitter collects a plurality of samples, stores the samples in a worn posture monitor device, and sends the samples in a batch to a remote processing point. In another embodiment, the transmitter is configured to transmit a signal for display (possibly to the user).

The transmitter 106 can be a part of a user feedback subsystem that provides corrective information to the user. The user feedback mechanism can include a device for measuring a composite three dimensional contour, wherein the three dimensional contour is calculated by integrating the individual curvature readings by each sensor. This data is converted to a form usable by the user. For example, the feedback to the user can be an audio signal instructing the user how to correct his or her posture.

The device 100 can be a wired version or a wireless version. In the wired version the user attaches a cable to worn device 100, like attaching a USB camera to a computer and transfer of signals happens automatically.

In the wireless version, the device 100 can be a small (e.g., shirt-pocket sized battery powered device with a small transmitter 106 that transmits less-than fully processed data collected from the sensors 122 to a remote processor. In the wireless version we can use a constant over-the air transmission to a remote device by Bluetooth™ or similar low power technology to provide a high sample rate. Alternatively, the device 100 can store in memory 110 monitoring signals periodically (e.g., every second) collected from the sensors 102 and periodically (e.g., once per day) transmit the signals to a remote device. In that embodiment the receiver 104 can be adapted to receive wireless signals from the remote processor and can provide feedback to the user by means of some user interface such audio messages or a tactile indication of correctable posture (e.g., vibration).

Figure 2:
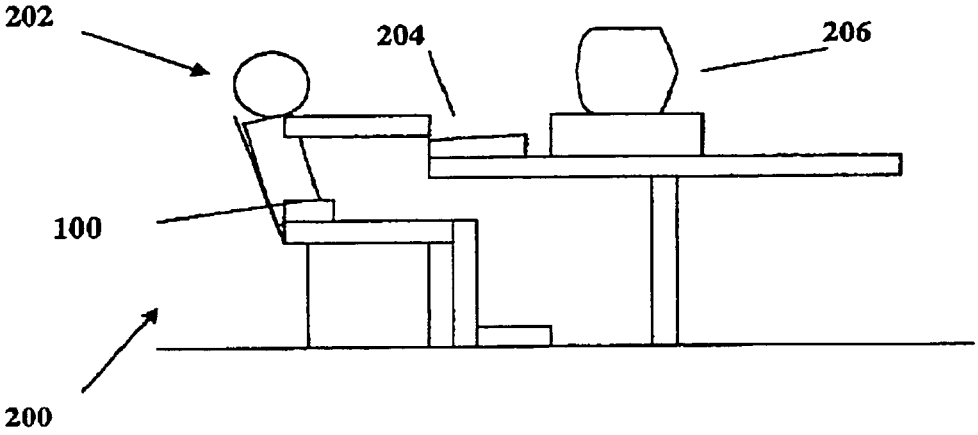
FIG. 2 shows a user of a device for monitoring posture at a computer workstation.

Referring to FIG. 2, there is shown an environment 200 with user 202 of the device 100 for monitoring posture at a computer workstation according to an embodiment of the invention. The user 202 is typing at a keyboard 204 while viewing a screen 206 (shown in FIG. 2) that provides feedback on the user's position and posture.

Figure 3:
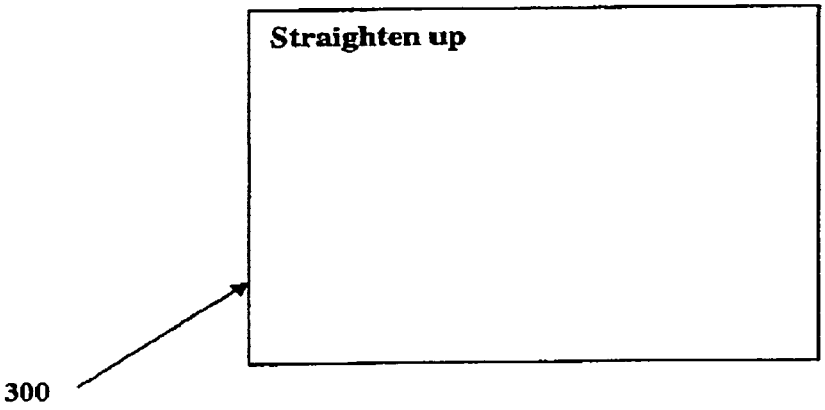
FIG. 3 shows a display presenting a user with feedback regarding the user's posture according to an embodiment of the invention.

Referring to FIG. 3, the screen 206 provides a display 300 with message to the user to straighten up. The screen 206 can also provide the user with feedback on how and when to change position or orientation. This feedback can also include a live animation of the user and other feedback that can be displayed to the user or a physician.

Figure 4:
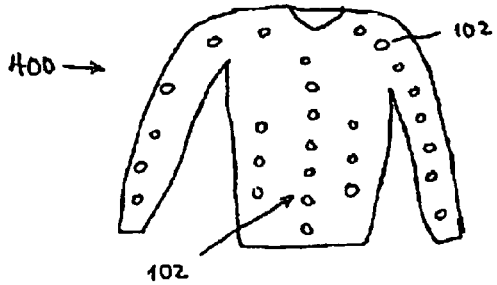
FIG. 4 shows a garment comprising position-determining devices according to another embodiment of the invention

Referring to FIG. 4, there is shown a jacket 400 comprising sensors 102 according to another embodiment of the invention. The sensors 102 are preferably position sensors, each for providing an indication of position of at least a part of the user's body. The sensors 102 can be piezoelectric sensors that are flexible and include small springs and track the curvature of the spine. It is also possible to use magnetic sensors (e.g., dipoles with a field detector) or fiber optic sensors. The sensors 302 can detect either two or three dimensional positions. The sensors 102 can also use smart textiles that have conductive threads integrated with the jacket 400 or a mesh or net probes that can adhere to the user's skin. In short, the sensors 102 can be embodied by any device that is capable of detecting a position or orientation.

The sensors 102 are each coupled to a processing unit (e.g., receiver 104, processor 108, or an external processor) that receives an indication of position or curvature for the part of the user's body with which it is in contact. The processing unit also transmits the position signal or signals to a point external to the device which can provide feedback to the user on the user's position or posture.

As briefly mentioned above, once the signals produced by the sensors 102 are processed by unit 108, the resulting composite signal can be sent to a physician, a machine for analysis, or other party for use in correcting the posture. The composite signal can be compared with a "prescribed signal" and the user can be issued feedback when the user's position deviates from the prescribed position by a certain margin. A prescribed signal can be loaded into the worn device either by wireless means or by wired means. A health care professional may specify this position using 3D geometry/CAD tools. For example if the user extends his back more than a prescribed amount, the user may be notified. Similarly, excess flexion can be detected and the user can be notified. In other cases, the physician may specify that the user can flex a certain number of times per a specified time interval—say twice an hour. The device can notify the user when the user exceeds the prescribed number.

Referring again to FIG. 3, the display 300 provides the user with feedback mechanism wherein the display to the user and wherein the signal provides information relating to correction of the user's posture. The device 500 includes a connection to a plurality of probes 502 worn by the user. This connection is not necessarily a wired connection. The connection could be wired or wireless. In this embodiment the user feedback mechanism comprises a computer system comprising a display that presents the user a representation of the user's posture and suggestions for improving the posture.

Figure 5:
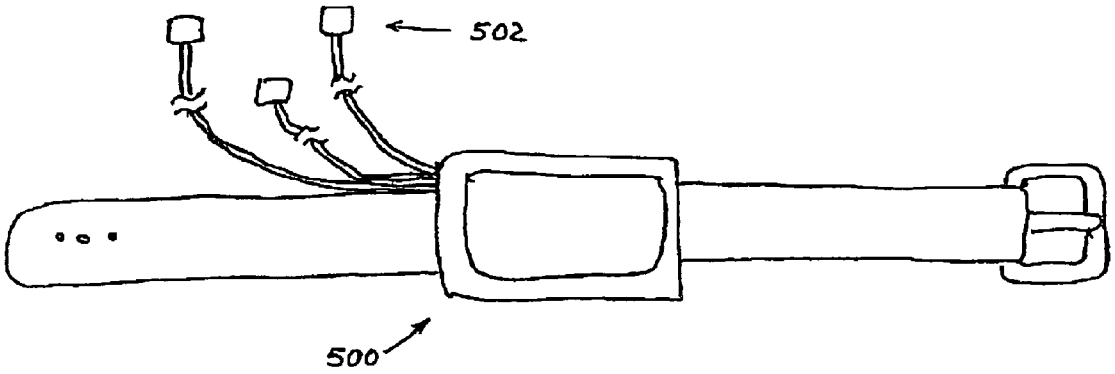
FIG. 5 shows a mobile device according to another embodiment of the invention worn by a user as he or she is walking or running.

Referring to FIG. 5 there is shown a mobile posture detection device 500 (e.g., a watch or digital personal assistant) that can be worn while walking or running. The device 500 includes a connection to a plurality of probes 502 worn by the user. These probes are similar or the same as those discussed above or with respect to FIG. 6. In this embodiment the user's walking posture is monitored for correctness and feedback to the user is provided in the same manner as other content presented to the user by the type of device worn. In the case where the device 500 is a watch, it can provide the user with a tactile feedback signal such a vibration generated by a vibrating motor in the watch. Alternatively, the user's care provider can monitor the user's walking or running posture and can either provide the user feedback later or in real time by, for example, calling the user's mobile phone.

Figure 6:
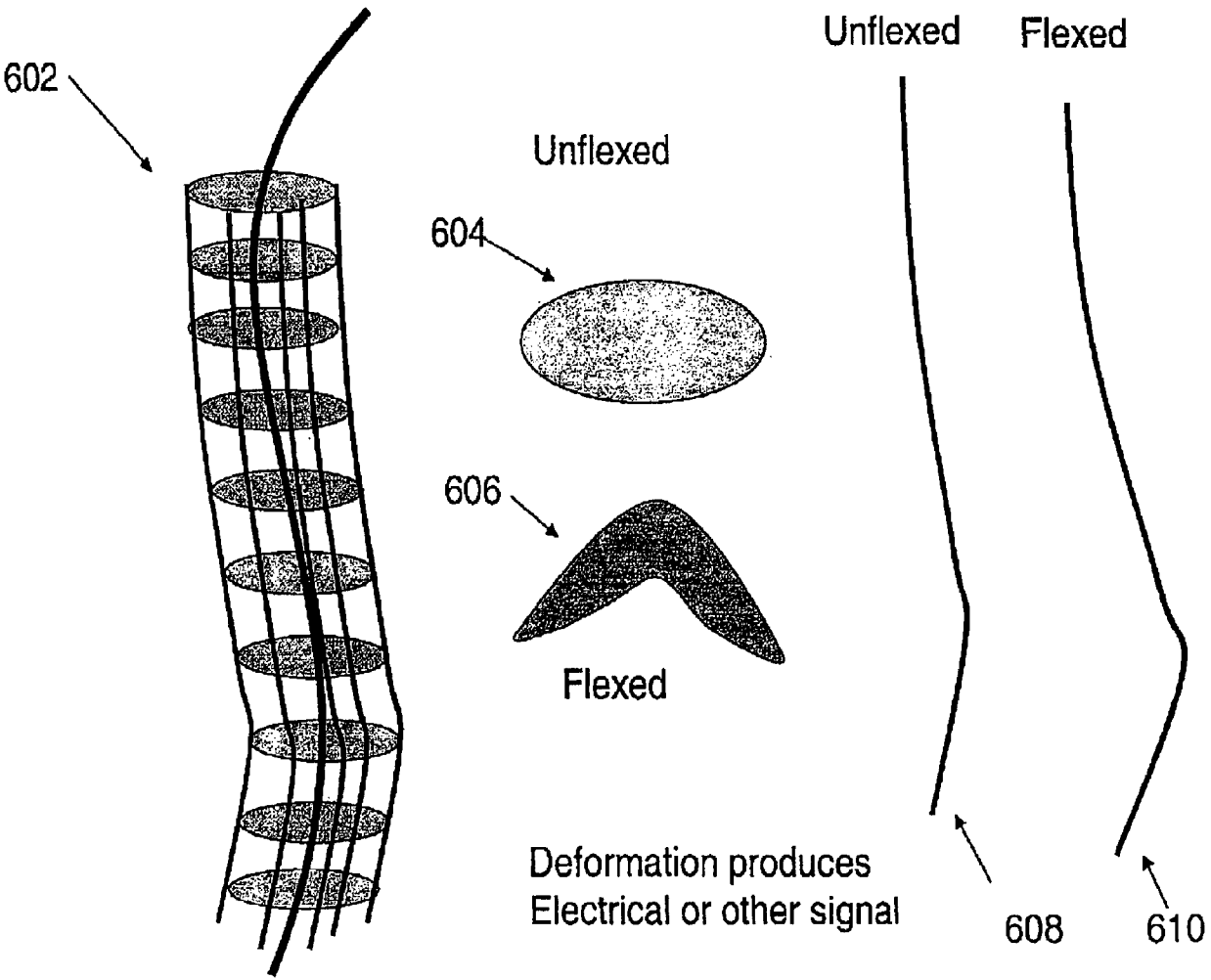
FIG. 6 shows a sensor for detecting spine curvature.

FIG. 6 shows a sensor 602 for detecting spine curvature. The sensor 602 is a tube that includes a plurality of disks 604 that have an oval shape in their normal state. The tube is attached to a user's spine such that when the spine is bent the disks located near the bend become flexed 606 and the resulting deformation produces an electrical signal. FIG. 6 also shows a representation of an unflexed sensor 608 and a flexed sensor 610. Sensors 608 and 604 also generate signals. The combination of signals from sensors 610 and 608 are used to determine the curvature of their wearer's back. As mentioned above, the sensors can use fiber optic, piezoelectric, or magnetic elements or other elements that generate measurable signals when bent.

Figure 7:
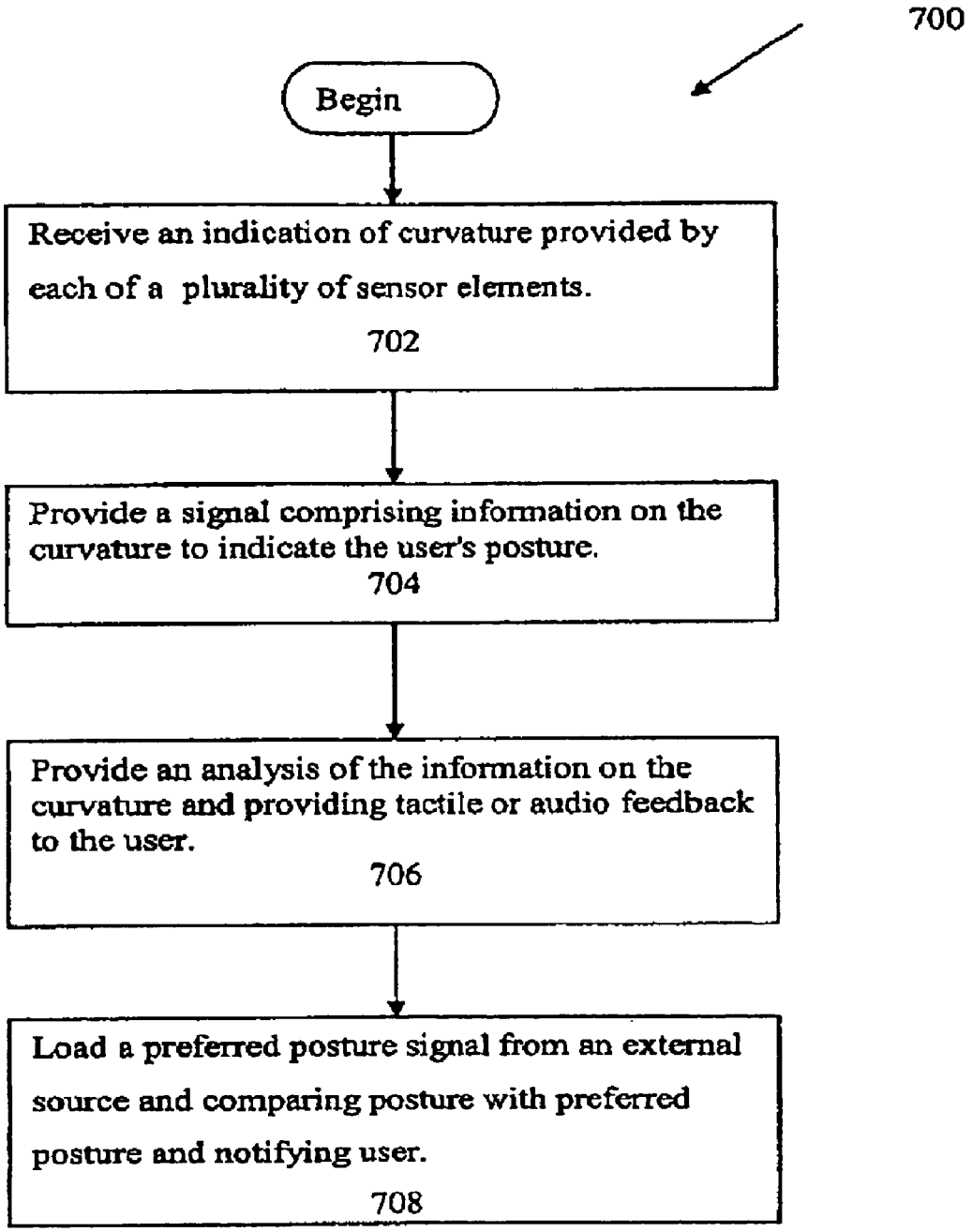
FIG. 7 is a flowchart of a method according to another embodiment.

Referring to FIG. 7, there is shown a flowchart illustrating a method 700 according to another embodiment of the invention. The method 700 comprises a step 702 of receiving an indication of curvature provided by each of a plurality of sensor elements, each attached to different points on the body of a user; and a step 704 of providing a signal comprising information on the curvature to indicate the user's posture. The method 700 may further include a step 706 performing an analysis of the information on the curvature and providing tactile or audio feedback to the user and a step 708 of loading a preferred posture signal from an external source and comparing posture with preferred posture and notifying user.

Therefore, while there has been described what is presently considered to be the preferred embodiment, it will understood by those skilled in the art that other modifications can be made within the spirit of the invention.

I claim:

1. A system for monitoring position of a user, the system comprising:

a wearable device, wearable by the user, comprising:

a composite unit comprising at least one tube disposed along the user's spine for providing an indication of a curvature of the user's spine where the tube is placed, said tube comprising:

a plurality of disks placed at regular intervals inside the tube, said disks having an oval shape in an un-flexed state such that when the user's spine is bent the disks located near the bend become flexed and a resulting deformation of the disk produces an electrical signal; and a plurality of sensor elements operatively coupled with the plurality of disks; and wherein the composite unit further comprises:

a processing unit operatively coupled with the composite unit, the processing unit comprising:

a receiver for receiving each indication of position change provided by each of the plurality of sensor elements to provide a composite position signal wherein the plurality of sensor elements are each operatively coupled with the receiver;

a transmitter, operatively coupled with the receiver, for transmitting the composite position signal to a processor;

an internal memory for receiving an initial placement position for each of the plurality of sensor elements; and the processor, operatively coupled with the receiver, for receiving the composite position signal and computing an indication of the user's posture; and a remote processing unit wirelessly coupled to the wearable device to monitor the position of the user as indicated by the curvature of the user's spine.

2. The system of claim 1, wherein the receiver of the wearable device is configured to receive information representing a three-dimensional position of each sensor element.

3. The system of claim 1, wherein the receiver of the wearable device is configured to receive information representing the position of each sensor element continuously.

4. The system of claim 1, wherein the receiver of the wearable device is configured to receive information representing the position of each sensor element at a high sample rate.

5. The system of claim 1, wherein the transmitter of the wearable device is configured to transmit the composite position signal to a physician for analysis.

6. The system of claim 1, wherein the transmitter of the wearable device is configured to transmit the composite position signal to the remote processing unit for analysis.

7. The system of claim 1, wherein at least one of the sensor elements of the wearable device is flexible.

8. The system of claim 1, further comprising a user feedback mechanism for providing a signal to the user and wherein the signal provides information relating to correction of the user's posture.

9. The system of claim 8, wherein the user feedback mechanism comprises a computer system comprising a display for presenting a representation of the user's posture and suggestions for improving the posture.

10. The system of claim 1, wherein the transmitter of the wearable device is configured to transmit the composite position signal to a therapist for analysis.

11. The system of claim 9, wherein the feedback mechanism comprises at least one selected from a group consisting of: a watch, a phone, and a music player.

12. The system of claim 2, wherein the processor of the wearable device is further configured for measuring a composite three dimensional contour, and wherein the three dimensional contour is calculated by integrating individual curvature readings by each sensor element.

13. The system of claim 1, wherein the individual sensor readings are transmitted to an external entity for further analysis.

14. The system of claim 1, wherein the transmitter of the wearable device is attached to the sensor.

15. The system of claim 1, wherein the transmitter of the wearable device is a wireless device.

* * * * *